US008295528B2

(12) United States Patent
Rombach et al.

(10) Patent No.: US 8,295,528 B2
(45) Date of Patent: Oct. 23, 2012

(54) BOARD MOUNTING OF MICROPHONE TRANSDUCER

(75) Inventors: Pirmin Herman Otto Rombach, Kgs. Lyngby (DK); Jorg Rehder, Virum (DK)

(73) Assignee: Epcos AG, Munich (DE)

( * ) Notice: Subject to any disclaimer, the term of this patent is extended or adjusted under 35 U.S.C. 154(b) by 510 days.

(21) Appl. No.: 12/516,120

(22) PCT Filed: Nov. 22, 2007

(86) PCT No.: PCT/EP2007/062688
§ 371 (c)(1),
(2), (4) Date: Feb. 2, 2010

(87) PCT Pub. No.: WO2008/062036
PCT Pub. Date: May 29, 2008

(65) Prior Publication Data

US 2010/0142744 A1 Jun. 10, 2010

Related U.S. Application Data

(60) Provisional application No. 60/903,940, filed on Feb. 28, 2007.

(30) Foreign Application Priority Data

Nov. 23, 2006 (DK) ..... 2006 01546

(51) Int. Cl.
*H04R 25/00* (2006.01)

(52) U.S. Cl. ..... 381/369; 381/333; 381/355

(58) Field of Classification Search ..... 381/369, 381/170, 173–175, 355, 360–361, 332–334, 381/388
See application file for complete search history.

(56) References Cited

U.S. PATENT DOCUMENTS

| | | | | |
|---|---|---|---|---|
| 6,018,584 | A | 1/2000 | Paulick | |
| 6,178,249 | B1 | 1/2001 | Hietanen et al. | |
| 7,903,831 | B2 * | 3/2011 | Song | 381/174 |
| 2004/0184632 | A1 | 9/2004 | Minervini | |
| 2006/0116180 | A1 | 6/2006 | Minervini | |
| 2006/0157841 | A1 | 7/2006 | Minervini | |
| 2008/0279407 | A1 | 11/2008 | Pahl | |

FOREIGN PATENT DOCUMENTS

| | | | |
|---|---|---|---|
| DE | 10232953 | B3 | 3/2004 |
| EP | 1 739 933 | B1 | 1/2008 |
| JP | 2003-087898 | A | 3/2003 |
| WO | 2007/024049 | A1 | 3/2007 |
| WO | 2007/054071 | A1 | 5/2007 |

OTHER PUBLICATIONS

International Search Report of International Application No. PCT/EP2007/062688, dated Aug. 8, 2008.

Written Opinion of the International Searching Authority of International Application No. PCT/EP2007/062688, dated Aug. 8, 2008.

* cited by examiner

*Primary Examiner* — Suhan Ni
(74) *Attorney, Agent, or Firm* — Nixon Peabody LLP

(57) ABSTRACT

A portable communication device assembly comprising a housing and a PCB provided therein. A microphone is provided at least partly within an aperture in the PCB, which aperture is positioned adjacent to a sound input of the housing. The microphone may be attached to a carrier element also attached to the PCB, and additional electronic components may be attached to the carrier element. Acoustic and/or electromagnetic shielding may be provided.

16 Claims, 5 Drawing Sheets

BOARD MOUNTING OF MICROPHONE TRANSDUCER

FIELD OF THE INVENTION

The present invention relates to a mobile terminal assembly comprising a mobile terminal printed circuit board having an aperture formed therein. The aperture extends between first and second substantially opposing surfaces of the mobile terminal printed circuit board and a microphone is positioned at least partly inside the aperture.

BACKGROUND OF THE INVENTION

US 2006/0157841 and US 2006/0116180 disclose respective MEMS microphone mounting concepts to attach surface mountable MEMS microphone packages to printed circuit boards disposed inside a housing or casing of an electronic device. A sound aperture is formed in a surface mountable carrier of the MEMS microphone package and another sound aperture extends through the printed circuit board of the communication device. A sound passage is formed through the respective sound apertures of the MEMS microphone carrier and the printed circuit board of the communication device to acoustically couple a transducer element disposed inside the MEMS microphone package to the exterior of the electronic device.

Additional systems may be seen in WO2007/024049 and 054071 as well as in EP1739933, JP2003-087898, US2004/184632 and U.S. Pat. No. 6,018,584.

SUMMARY OF THE INVENTION

According to an aspect of the present invention a microphone is positioned at least partly within an aperture formed in a printed circuit board of a portable communication device such as a mobile terminal, mobile phone, headset or hearing prostheses. A significant advantage of the present invention is that the devised mobile terminal assembly partly or entirely eliminates acoustical impedances associated with sound propagation through the respective apertures of the printed circuit board of the mobile terminal and an interior sound path of the microphone package. Instead, the present portable communication device assembly allows the microphone to be located proximate to the sound inlet of the portable communication device to optimize the acoustical performance of the combined microphone assembly and sound inlet construction.

In view of the above-mentioned object, an implementation of the present invention relates to a portable communication device assembly comprising:

a housing comprising a housing portion having first opening for receiving sound;

a first printed circuit board positioned adjacent to the housing portion and comprising a second opening or cavity positioned adjacent to the first opening; and a microphone for receiving sound, the microphone being positioned at least partly in the second opening or cavity.

In a first preferred embodiment, the second opening or cavity extends through the first printed circuit board from a first surface to a second opposing surface thereof. In this implementation, the portable communication device assembly may further comprise a carrier element supporting or holding the microphone and attached to the first printed circuit board. This carrier element may be attached to or at a surface portion of the first PCB facing away from the surface part of the portable communication device housing having the opening for example by gluing, bonding or soldering.

In a number of situations, it is preferred that the sound entering the first opening is allowed to propagate to the microphone in an undistorted manner and without significant attenuation within the audio frequency band from 100 Hz to 10 kHz. In addition, it may be desired to attenuate sound from other sound sources such as internally located receivers and/or loudspeakers. To achieve this result, the portable communication device 1 preferably comprises an acoustical seal provided between the first printed circuit board and the carrier element for acoustically sealing the second opening or cavity at the first side of the first printed circuit board.

In addition, it may be desired to provide a second acoustical seal between the first PCB and the housing around the first and second openings in order to also prevent sound from reaching the microphone from between the first PCB and the housing.

In a number of situations, it is advantageous to shield the microphone or other electronic components such as an integrated circuit and electrical traces/paths positioned adjacent to the microphone from electromagnetic fields. Thus, preferably, the portable communication device assembly or communication device assembly further comprises an electromagnetic shield provided between the first printed circuit board and the carrier element for electromagnetically shielding the microphone from the surroundings of the first printed circuit board and the carrier element.

It may additionally be desired that the first PCB provides an EMC sealing, at least by the EMC sealing provided by the conductors thereof.

Also, the carrier element may comprise an electromagnetic shield either by using an electrically conductive plane (or conductors positioned in that plane) electrical conductors positioned at circumferential edge portions thereof and at an angle to the plane of the carrier element. This plane of the carrier element would normally be parallel to a plane of the first PCB. Thus, the carrier element may be adapted to block or attenuate electromagnetic fields entering the carrier element both at a major surface thereof as well as via edges thereof.

Non-limiting examples of the first PCB and the carrier element are: a standard PCB, a ceramic substrate, a semiconductor substrate (typically Silicon-based), LTCC (Low Temperature Co-fired Ceramic) and HTCC (High Temperature Co-fired Ceramic). Preferably, the PCB and the carrier element each comprise an electrically non-conducting base material and support micron-size features.

In a preferred embodiment, when the second opening extends through the first PCB:

the carrier element is a second printed circuit board comprising a number of electrically conducting paths;

the microphone is electrically connected to one or more of the conducting paths; and one or more of the conducting paths are electrically connected to conductive parts of the first printed circuit board.

Thus, the microphone may simply be fixed or attached to the carrier element and the second carrier element may be fixed to the first PCB via this electrically conducting connection (typically soldering). This electrically conducting connection may e.g. be wire-bonding or flip chip mounting.

These electrically conducting connections may be provided at the same side of the carrier element which may then be connected to a side of the first PCB facing away from the surface portion of the housing.

In addition, the above shielding (acoustical and/or electromagnetic) may be provided between the carrier element and the first PCB also by e.g. a ring (preferably forming a closed curve) of solder surrounding (in a projection on to a plane of the first PCB) the electrical connections of the microphone and the carrier element and the connections between the carrier element and the first PCB.

The above-mentioned optional electrical shielding around the edge portions of the carrier element may advantageously comprise a number of standard vias extending along the edge portions, and the electrical shielding in the plane of the carrier element may be provided by conducting paths thereof in one or more path layers thereof as is known in standard PCBs.

Naturally, additional electronic components may be connected to the conducting paths of the carrier element. In the situation where the above electrical shielding is used, these components may be positioned inside the electrically shielded area. Such components may be amplifiers such as low-noise microphone preamplifiers, decoupling or voltage supply capacitors, voltage multipliers, voltage regulators, or the like.

In general, even though a microphone is an element comprising a diaphragm having on either side thereof a cavity (normally denoted the front chamber and the back chamber), it is not required that the microphone be a monolithic or unitary element. In a preferred embodiment, the microphone comprises a first and a second pan engaging each other, such as in a detachable manner, where:

the first part comprises a diaphragm and comprising an inner surface defining a cavity, the diaphragm forming at least part of the inner surface;

the second part defines a cavity having an opening facing the diaphragm.

In that implementation, the first and second parts may be provided or manufactured separately from each other, and may be assembled at any desired point in time or may even subsequently be detached again.

Preferably, the first and second parts engage in a manner so that an acoustic sealing is provided there between. A sealing member may be used if desired.

In this situation, the second part may be formed by at least a part of the second cavity in the first PCB. The first part may then be positioned outside the second cavity or at least partly within the second cavity with the diaphragm facing the second cavity or a "deeper part" of the second cavity (a part further into the cavity than the first part).

Also, when the second opening or cavity extends through the first printed circuit board from a first side to a second side thereof, the second part of the microphone may then be formed by a cavity in a second element which is attached to the first printed circuit board. Then, the first part of the microphone may be attached to the second element or the first PCB.

Any type of microphone may be used in the present invention, such as a condenser or electret microphone transducer. Due to the preferred soldering operation in connecting the microphone to the first PCB or the carrier element, it is advantageous that the microphone comprises a MEMS transducer element, which is a transducer element wholly or at least partly fabricated by application of Micro Mechanical System Technology, or a temperature resistant ASIC in that this facilitates such soldering. The microphone may form part of a Chip-Scale-Packaged (CSP) MEMS microphone assembly, and it may advantageously comprise an electronic circuit die electrically coupled to the microphone to amplify or buffer electrical signals generated by the microphone in response to receipt of sound. A suitable amplification circuit for this and other purposes is disclosed in e.g. EP-A-1553696.

According to a preferred embodiment of the invention, the microphone comprises a MEMS transducer with a diaphragm to back plate distance of 1-20 μm or more preferably 1-10 μm, such as 1-5 μm. The MEMS transducer may have an extension, in the plane of the diaphragm, of less than 4.0 mm×4.0 mm such as 3.5 mm×3.5 mm or even more preferably less than 3.0 mm×3.0 mm. The MEMS microphone transducer may comprise a semiconductor material such as Silicon or Gallium Arsenide in combination with conductive and/or isolating materials such as silicon nitride, polycrystalline silicon, silicon oxide and glass. Alternatively the microphone may comprise solely conductive materials such as aluminium, copper etc., optionally in combination with isolating materials like glass and/or silicon oxide.

A second aspect of the invention relates to a microphone assembly for use in the portable communication device according to the first aspect, the assembly comprising:

an electro acoustic transducer adapted to output an electrical signal, a processing circuit adapted to process the electrical signal from the transducer, a carrier element having a first and a second sides, the transducer and processing circuit being fixed to the same side of the carrier element.

In one embodiment, the carrier element has a hole in the side thereof, and wherein the transducer element is positioned so as to cover the hole. In this embodiment, the transducer may use be of a type using the hole as one of the front or back chambers thereof. In that situation, the transducer may comprise a diaphragm, one side of which is acoustically connected to the hole. This transducer may comprise a housing having an opening into the hole, or the pertaining side of the diaphragm may be fully exposed to the hole.

In another embodiment, the carrier element has, on the side thereof and encircling the transducer and the circuit, a sealing element adapted to seal against a printed circuit to which it is connected when mounted in the communication device. This sealing element may be an acoustic sealing element, such as a resilient element contacting the carrier element and the PCB when the present assembly is mounted vis-à-vis the PCB. In another situation, the sealing element may be adapted to protect the transducer and circuit from external electrical fields (EMC shielding), whereby it may be formed by a conducting sealing surrounding the transducer and circuit and contacting (preferably along the periphery thereof) (or being adapted to support a conducting material contacting) both the carrier element and the PCB. Also, the carrier element may comprise, therein in a plane, which may be parallel to or not perpendicular to a plane of the surface, one or more electrical conductors adapted to shield the circuit from external electromagnetic fields.

In yet another embodiment, the carrier element further comprises electrical conductors connecting the transducer and the circuit. Actually, the transducer and the circuit may be fixed to the carrier element via electrical connections (such as via solder bumps), which carry signals from the transducer to the circuit via the electrical conductors of the carrier element. The carrier element may then be a PCB.

In a third aspect, the present invention relates to a portable communication device comprising a portable communication device assembly according to the first aspect of the present invention. As previously-mentioned, the portable communication device may be a mobile terminal, cellular phone, a hearing prostheses, headset or any combination thereof.

BRIEF DESCRIPTION OF THE DRAWINGS

The present invention will now be explained in further details with reference to the accompanying figures, wherein.

DETAILED DESCRIPTION OF THE INVENTION

Figure 1A:
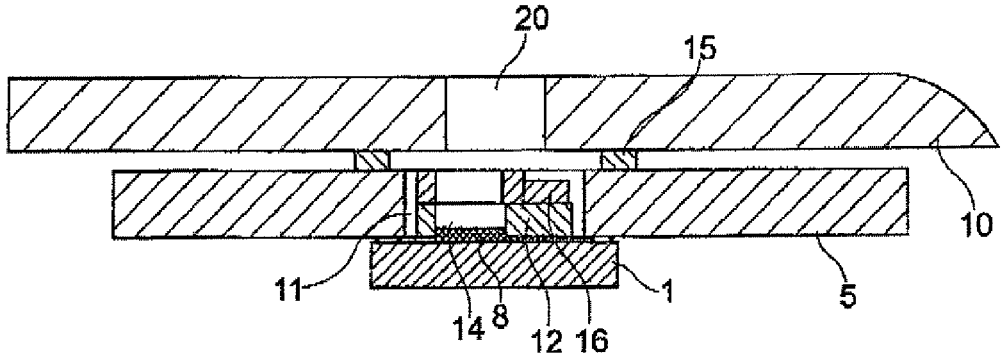
FIGS. 1*a* and *b* show cross-sectional and perspective views, respectively, of mobile terminal assembly according to a first embodiment of the present invention.

In FIGS. 1*a* and *b*, a mobile terminal assembly comprises a mobile terminal printed circuit board 5 disposed inside a casing or housing 10 of a mobile terminal (not shown). A Chip-Scale-Packaged (CSP) MEMS microphone 8 is mounted onto and electrically coupled to a first surface of an intermediate carrier 1 that preferably comprises a printed circuit board.

The CSP packaged MEMS microphone assembly 8 comprises a semiconductor or ceramic substrate 12 that holds a MEMS transducer element 13 in form of a MEMS condenser transducer. The semiconductor substrate 12 may advantageously comprise an indentation or cut-out 14 aligned with and positioned beneath a diaphragm/back plate assembly of the MEMS transducer element 13. The indentation 14 functions as a back chamber for the MEMS transducer element 13. The MEMS transducer element 13 is adjacently positioned to an electronic circuit die 16 that preferably comprises a low-noise preamplifier, and optionally and A/D converter and/or a voltage regulator and a voltage multiplier, electrically coupled to the MEMS transducer element 13 through interconnections supplied on the semiconductor substrate 12, or alternatively, directly between respective bonding pads on the MEMS transducer element and the electronic circuit die 16.

The entire CSP MEMS microphone assembly 8 is located within a second opening 11 formed in mobile terminal printed circuit board 5 and that extends between opposing upper and lower surfaces of the printed circuit board 5.

Sound or acoustical signals from the exterior environment propagate through the sound inlet 20 in the casing 10 of the mobile terminal to a diaphragm of the MEMS condenser transducer 13. A compressible gasket 15 is arranged on a first or upper surface of the mobile terminal printed circuit board 5 and surrounds the second opening 11 formed therein. The compressible gasket 15 is disposed in-between the casing 10 of the mobile terminal and the mobile terminal printed circuit board 5 to abut these and to surround the sound inlet 20 and the second opening 11. Thereby, the sound path to the CSP packaged MEMS microphone 8 is acoustically sealed from the interior of the mobile terminal.

The CSP packaged MEMS microphone assembly 8 and the first surface of an intermediate carrier 1 comprises aligned respective sets of electrically conductive bumps or terminals 8' to allow compact flip-chip mounting of the CSP packaged MEMS microphone 8 on the intermediate carrier 1 having corresponding terminals 19' and the die 16 as well, using terminals 16'. However, other interconnection mechanisms are possible such as wire bonding etc.

The first surface 6 of an intermediate carrier 1 additionally comprises a second set of electrically conductive bumps 3 that can be soldered to mating electrical terminals 3' placed on the second or lower side of the mobile terminal printed circuit board 5 to establish electrical and mechanical contact between the printed circuit board 5 and the intermediate carrier 1. The printed circuit board 5 typically comprises electronic components of the mobile terminal and circuits for receipt and processing of microphone signals generated by the CSP packaged MEMS microphone assembly 8.

The first surface 6 of the intermediate carrier 1 additionally comprises a peripherally extending solder ring 2 that is operative to acoustically seal the CSP packaged MEMS microphone 8 from the interior space of the mobile terminal situated below the printed circuit board 5. The solder ring 2 may advantageously be soldered onto a corresponding electrical trace 2' patterned on the lower side of the mobile terminal printed circuit board 5. The combination of the mutually interconnected CSP packaged MEMS microphone assembly 8 and the intermediate carrier 1 may be viewed as a MEMS microphone assembly or package/component that is reflow solderable to the printed circuit board 5 residing in the mobile terminal.

Furthermore, the solder ring 2 may additionally function to EMC shield the CSP packaged MEMS microphone 8 for example by connecting the solder ring 2 to a suitable electrical potential such as a DC supply potential or ground potential.

The shielding effect of the carrier 1 may be increased by using electrically conducting paths thereof (not illustrated), such as paths provided in an inner layer thereof or provided on a side opposite to that having the bumps 3, and vias may be provided through the carrier 1 at peripheral parts thereof (at or under the ring 2) in order to also provide an EMC shielding of electromagnetic fields entering through the carrier 1 from the back side or the edges thereof.

Naturally additional electronic elements, such as amplifiers or decoupling capacitors, may be provided on the carrier 1 and within the ring 2, in order to take advantage of electrical connection to e.g. the microphone 8 while being within the shielded area.

Preferably the carrier 1 is as small as possible while providing the an area sufficient for the microphone 8, the ring 2 to seal around the aperture 11 and for holding any desired additional electronic components. An area of 4×4 mm or 4×3 mm is obtainable.

Figure 2A:
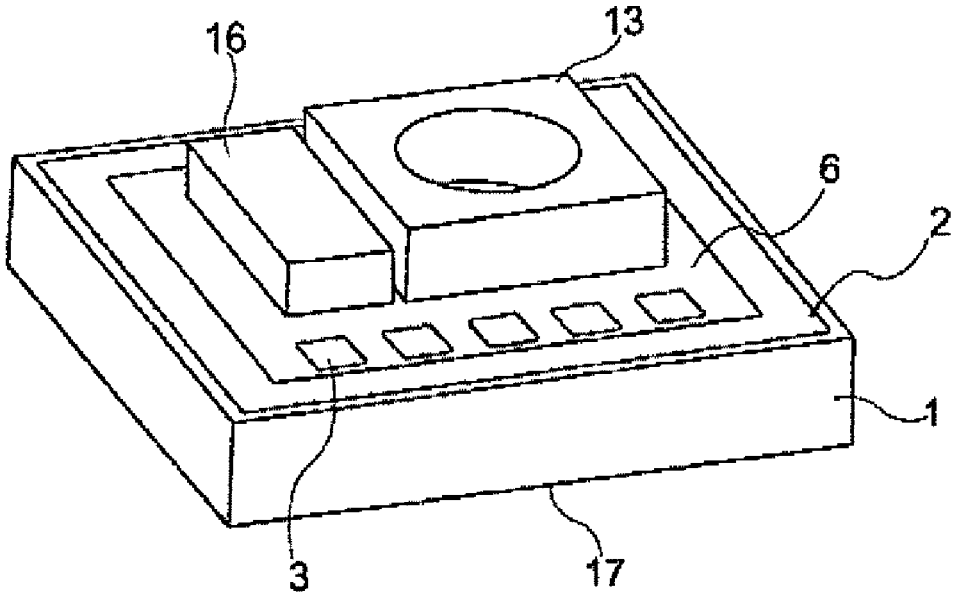
FIGS. 2*a* and *b* show cross-sectional and perspective views, respectively, of a MEMS microphone assembly according to a second embodiment of the present invention.
Figure 2B:
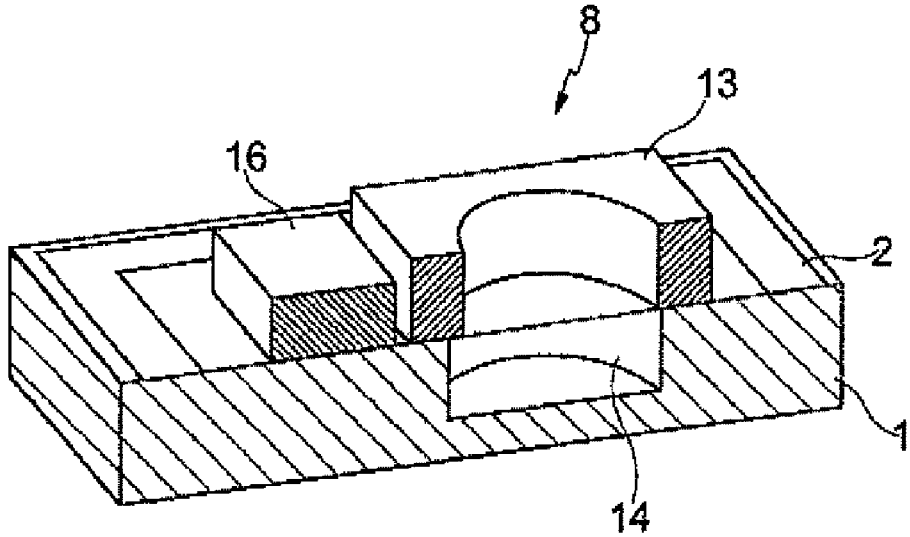

In FIGS. 2*a* and *b*, a second embodiment of the invention is illustrated wherein the CSP MEMS microphone assembly 8 of the first embodiment has been replaced with a simplified MEMS microphone assembly 17 wherein the MEMS transducer element 13 is directly attached and electrically coupled to the intermediate carrier 1 or carrier. The carrier 1 is mounted to a mobile terminal printed circuit board 5 in a manner similar to the first embodiment so as to position the MEMS transducer element 13 at least partly inside the second opening 11 that extends through opposing upper and lower surfaces of the mobile terminal printed circuit board 5.

It is seen that the microphone 8 is now provided as two separate parts of which one is a back cavity provided in the carrier 1. The other part 13 of the microphone 8 also comprises a cavity (or parts defining a cavity) and the diaphragm of the microphone 8.

Figure 1B:
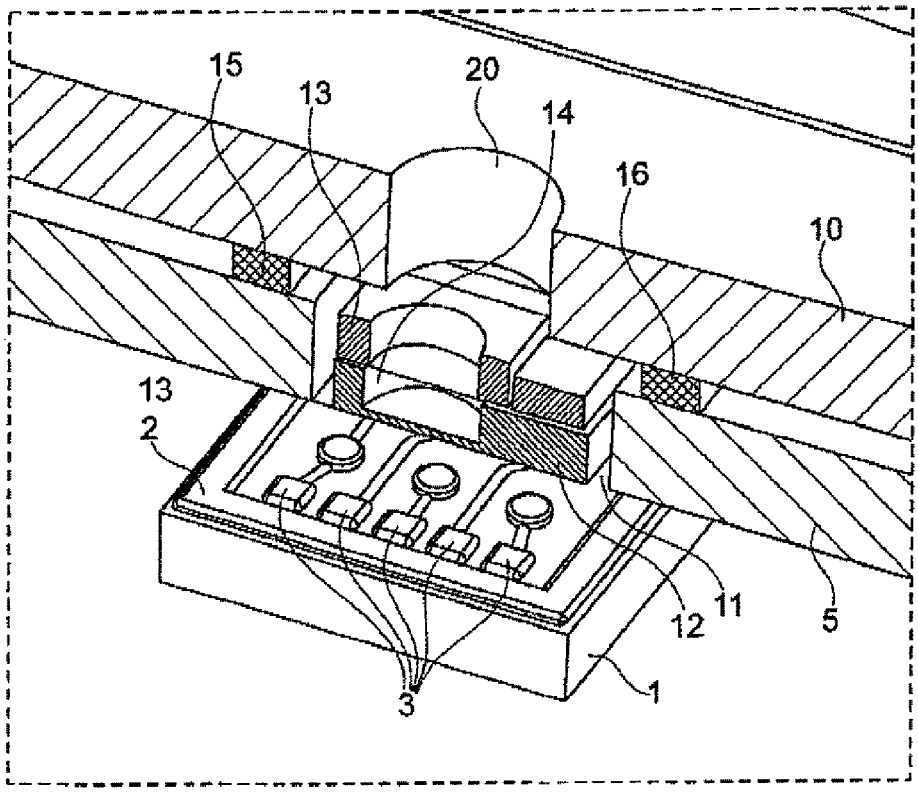

In comparison with the first embodiment, the MEMS microphone of the present embodiment lacks the semiconductor substrate 12 residing within the CSP MEMS microphone assembly of FIG. 1. Advantages of the present embodiment are its lower parts count and cost. Furthermore, the present MEMS microphone may have lower overall height. A MEMS microphone may have a height of only 400 μm, and a standard PCB has a thickness of 900 μm. However, if the PCB is a flex print, the height of the MEMS microphone may be deciding for the overall height of the assembly.

As illustrated by FIGS. 2*a* and *b*, an electronic circuit die 16, as described above in relation to FIGS. 1*a* and *b*, may be placed adjacently to the MEMS transducer element 13 and electrically coupled thereto. Naturally, the MEMS transducer element 13 and the electronic circuit die 16 may be integrated on a common semiconductor substrate.

A lower surface of the MEMS transducer element 13 and the first or upper surface 6 of the intermediate carrier 1 may advantageously comprise respective sets of aligned electrically conductive bumps or terminals to allow compact flip-chip mounting of the MEMS transducer element 13 on the intermediate carrier 1. The electronic circuit die 16 may also be connected to the intermediate carrier 1 in a similar manner. However, other interconnection mechanisms between the intermediate carrier 1 and electronic circuit die 16 and/or the MEMS transducer element 13 are naturally possible such as wire bonding etc. The intermediate carrier 1 preferably comprises, or is formed in, a conventional piece of printed circuit board. The intermediate carrier 1 may advantageously comprise an indentation or cut-out 14 aligned with and positioned beneath a diaphragm/back plate assembly of the MEMS transducer element 13. The indentation 14 may be formed in the intermediate carrier 1 by laser cutting, punching or drilling and functions as a back chamber for the MEMS transducer element 13.

The first surface of an intermediate carrier 1 additionally comprises a second set of electrically conductive bumps 3 that are solderable to mating electrical terminals placed on the second or lower side of a mobile terminal printed circuit board 5 as illustrated in FIGS. 1*a* and *b*. Electrical and mechanical contact is thereby established between the printed circuit board 5 and the intermediate carrier 1. The printed circuit board 5 typically comprises electronic components of the mobile terminal and circuits for receipt and processing of microphone signals generated by the MEMS transducer element 13.

The first surface of an intermediate carrier 1 additionally comprises a peripherally extending solder ring 2 that is operative to acoustically seal the MEMS transducer element 13 from the interior space of the mobile terminal situated below the printed circuit board 5. The solder ring 2 may advantageously also function to EMC shield the MEMS transducer element 13 for example by connecting the solder ring 2 to a suitable electrical potential such as ground potential.

An alternative to the second embodiment is one, wherein the indentation 14 is instead provided in the PCB 5, whereby the part 13 is simply provided above or also within the indentation in the PCB 5. This further reduces the height of the assembly.

Figure 3A:
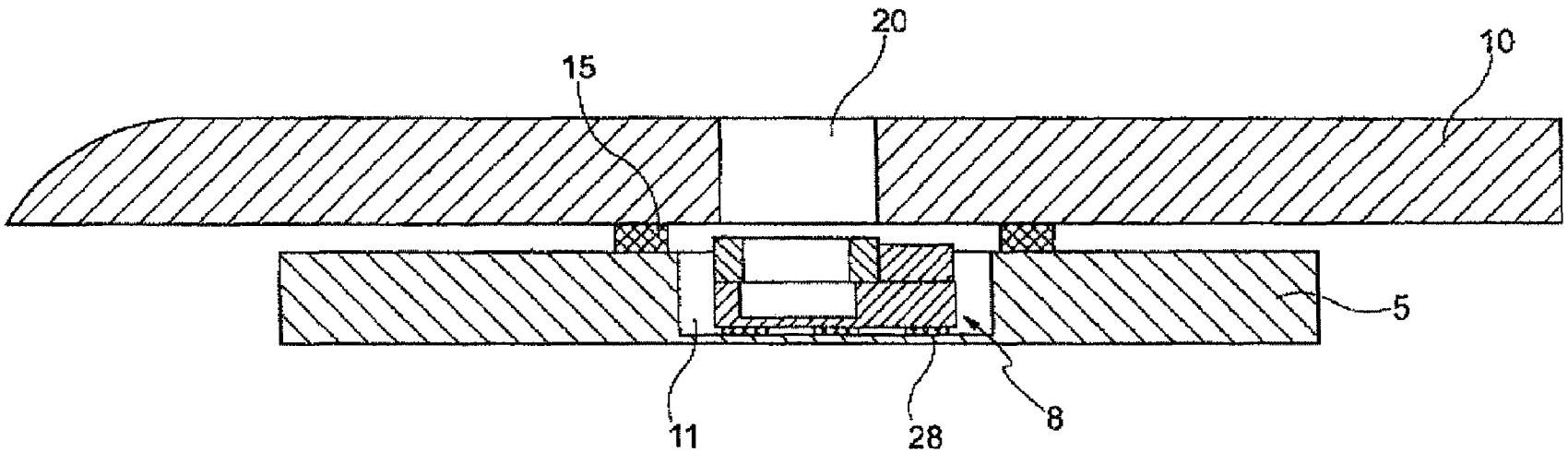
FIGS. 3*a* and *b* show cross-sectional and perspective views, respectively, of mobile terminal assembly according to a third embodiment of the present invention.
Figure 3B:
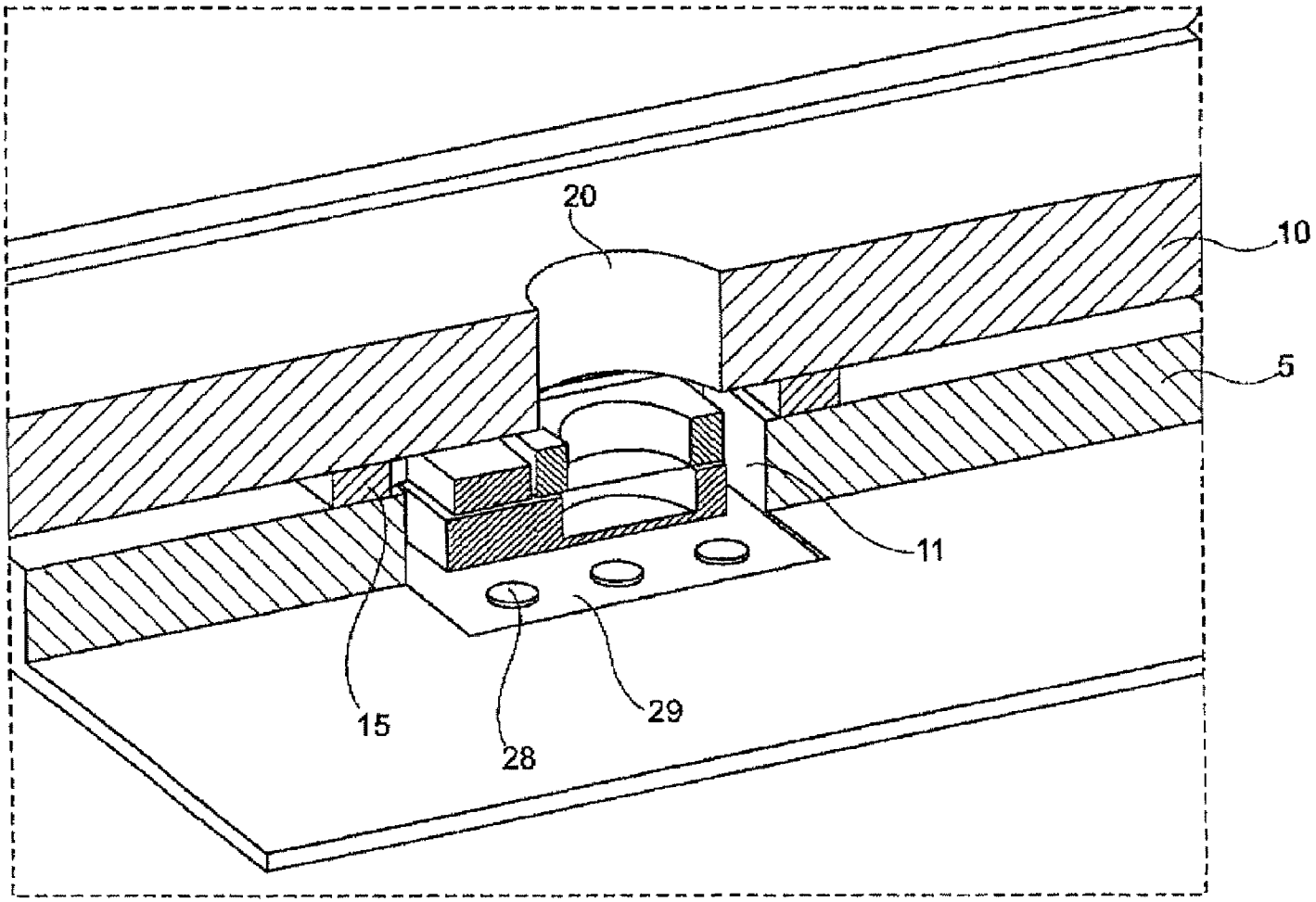

FIGS. 3*a* and 3*b* illustrate a third embodiment, in which the microphone 8 is positioned within the indentation 11 of the PCB 5, which does now not extend all the way through the PCB 5 for forming a through-going aperture. In this embodiment of the invention, the PCB 5 may have soldering pads 28 arranged at a bottom or lower surface 29 of the aperture or indentation 11. The PCB 5 may be a multilayer PCB, where the surface 29 is a surface of an internal layer of the PCB 5.

Naturally, additional electronic components may be provided in the indentation 11, such as on the layer 29, by providing additional bumps/pads 28 for attachment of such components.

If EMC-shielding is desired in the embodiment of FIG. 3, a lower layer or the lower surface of the PCB 5 may be used therefore as may vias provided around the exposed surface 29 in the same manner as is described in relation to FIG. 1.

Figure 4A:
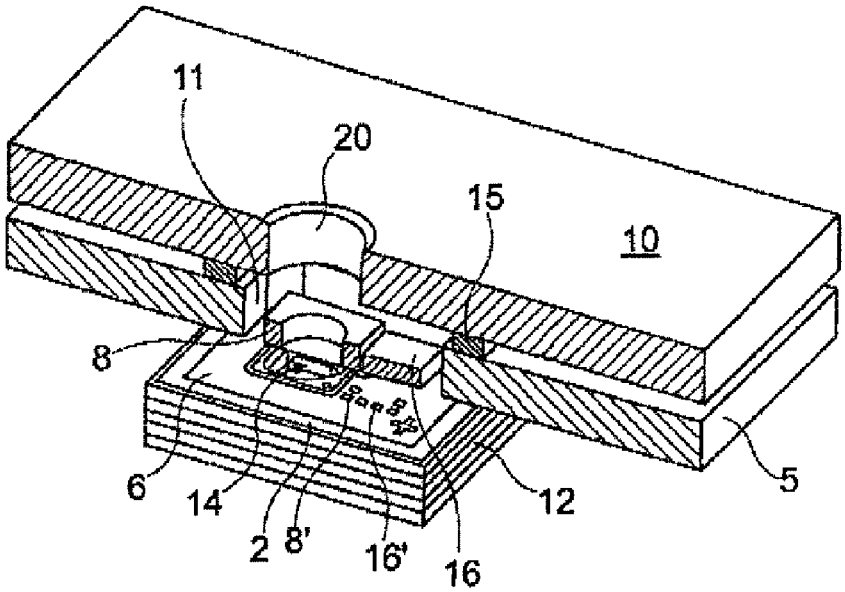
FIGS. 4*a* and *b* illustrate the embodiment in more detail.
Figure 4B:
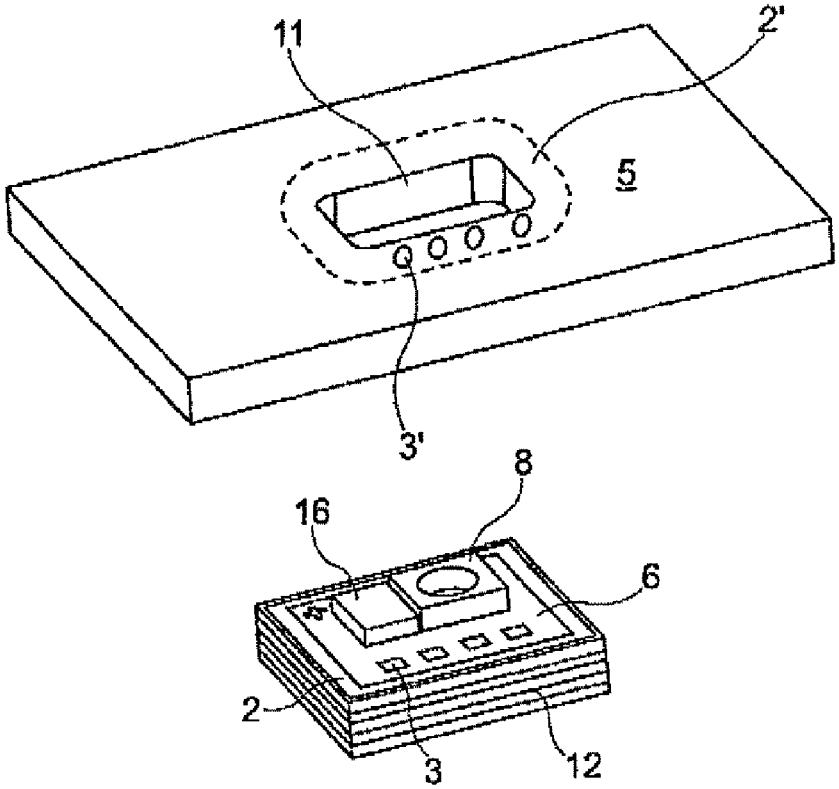

In FIGS. 4*a* and *b*, the microphone assembly comprising the microphone 8, the circuit 16 as well as the substrate 12, in this embodiment having the hole 14 for use by the microphone 8, is illustrated attached to and separated from the PCB 5. It is seen that the PCB and substrate 12 have mating contacts or terminals 3 and 3' for carrying signals there between as well as mating encircling, conducting paths 2 and 2' for providing an electromagnetic sealing of the circuit 16 from the surroundings.

In general, it is seen as an advantage that the overall height of the microphone 8 and circuit 16 is sufficiently low for them to not extend beyond the upper surface of the PCB 5 in order for them to be protected from shear forces exerted between the PCB 5 and the casing 10, which may come about when handling or dropping the telephone. Such forces are taken up by the gasket 15 with no damage to the other elements.

The invention claimed is:

1. A portable communication device assembly comprising:

a housing comprising a housing portion having first opening for receiving sound;

a first printed circuit board positioned adjacent to the housing portion and comprising a second opening or cavity positioned adjacent to the first opening;

a microphone for generating sound, the microphone being positioned at least partly in the second opening or cavity;

wherein the second opening or cavity extends through the first printed circuit board from a first side to a second side thereof, the communication device assembly further comprising a carrier element attached to the first printed circuit board and to which the microphone is attached, and wherein the carrier element is arranged on the first side of the first printed circuit board and the housing portion is arranged on the second side of the first printed circuit board.

2. A portable communication device assembly according to claim 1, further comprising means provided between the first printed circuit board and the carrier element for acoustically scaling the second opening or cavity at the first side of the first printed circuit board.

3. A portable communication device assembly according to claim 1, further comprising means provided between the first printed circuit board and the carrier element for electromagnetically sealing the microphone from the surroundings of the first printed circuit board and the carrier element.

4. A portable communication device assembly according to claim 1, wherein:

the carrier element is a second printed circuit board comprising a number of electrically conducting paths;

the microphone is electrically connected to one or more of the conducting paths; and one or more of the conducting paths are electrically connected to conductive parts of the first conductive circuit board.

5. A portable communication device assembly according to claim 4, further comprising electronic components connected to the conducting paths of the carrier element.

6. A portable communication device assembly according to claim 4, wherein the second opening or cavity extends through the first printed circuit board from a first side to a second side thereof, and wherein the second part is formed by at least a part of a cavity of a second element attached to the first printed circuit board.

7. A portable communication device assembly according to claim 1, wherein the microphone comprises a first and a second part engaging each other:

the first part comprising a diaphragm and comprising an inner surface defining a cavity, the diaphragm fanning at least part of the inner surface;

the second part defining a cavity having an opening facing the diaphragm.

8. A portable communication device assembly according to claim 7, wherein the second part is formed by at least part of the second opening or cavity of the first printed circuit board.

9. A portable communication device assembly according to claim 1, wherein the microphone comprises a MEMS transducer element or a temperature resistant ASIC.

10. A portable communication device assembly according to claim 1, wherein the assembly comprises:

an electroacoustic transducer adapted to output an electrical signal and a processing circuit adapted to process the electrical signal from the transducer, the carrier element having a first side and a second side, and the transducer and processing circuit being fixed to the same side of the carrier element.

11. An assembly according to claim 10, wherein the carrier element further comprises electrical conductors connecting the transducer and the circuit.

12. An assembly according to claim 10, wherein the carrier element has a hole in the side thereof, and wherein the transducer element is positioned so as to cover the hole.

13. An assembly according to claim 10, wherein the carrier element has, on the side thereof and encircling the transducer and the circuit, a sealing element.

14. A portable communication device comprising a portable communication device assembly according to claim 1.

15. A portable communication device assembly comprising:

a housing comprising a housing portion having a first opening for receiving sound;

a first printed circuit board positioned adjacent to the housing portion and comprising a second opening or cavity positioned adjacent to the first opening; and a microphone for generating sound, the microphone being positioned at least partly in the second opening or cavity, wherein the second opening or cavity extends through the first printed circuit board from a first side to a second side thereof, the communication device assembly further comprising a carrier element attached to the first printed circuit board and to which the microphone is attached, and wherein the first printed circuit board, the microphone and the carrier element are arranged inside the housing.

16. A portable communication device assembly comprising:

a housing comprising a housing portion having a first opening for receiving sound;

a first printed circuit board positioned adjacent to the housing portion and comprising a second opening or cavity positioned adjacent to the first opening; and a microphone for generating sound, the microphone being positioned at least partly in the second opening or cavity, wherein the microphone comprises a first and a second part engaging each other:

the first part comprising a diaphragm and comprising an inner surface defining a cavity, the diaphragm forming at least part of the inner surface;

the second part defining a cavity having an opening facing the diaphragm, and wherein the second part is formed by at least part of the second cavity of the first printed circuit board.

* * * * *